US007560627B2

(12) United States Patent
Stahnke

(10) Patent No.: US 7,560,627 B2
(45) Date of Patent: Jul. 14, 2009

(54) SYSTEM AND METHOD FOR DRIVING ACTUATORS IN A REPRODUCING PIANO

(76) Inventor: Wayne Stahnke, 1033 Fernleaf Dr., Sunnyvale, CA (US) 94086

( * ) Notice: Subject to any disclaimer, the term of this patent is extended or adjusted under 35 U.S.C. 154(b) by 795 days.

(21) Appl. No.: 11/097,211

(22) Filed: Apr. 4, 2005

(65) Prior Publication Data

US 2006/0219082 A1 Oct. 5, 2006

(51) Int. Cl.
*G10F 1/02* (2006.01)

(52) U.S. Cl. ..... 84/20; 84/13; 84/18; 84/19; 84/720; 84/745

(58) Field of Classification Search ..... None
See application file for complete search history.

(56) References Cited

U.S. PATENT DOCUMENTS 3,514,522 A * 5/1970 Mussulman ..... 84/724
4,628,785 A * 12/1986 Buchla ..... 84/689
5,444,378 A * 8/1995 Rogers ..... 324/428
6,106,472 A * 8/2000 Chiang et al. ..... 600/447

* cited by examiner

*Primary Examiner*—Marlon T Fletcher

(57) ABSTRACT

A method and system for controlling actuators in a mechanical reproducing piano or other instrument. In one implementation, a single finite state machine is provided to control all the actuators. The finite state machine may be or include a shift register or a toggle register, which increases the operating speed. When a note is to be played, the desired dynamic is mapped into a start vector and a stop vector. The actuator is turned on when the state of the finite state machine is equal to the start vector, and is turned off when the state of the finite state machine is equal to the stop vector. Furthermore, the period of the finite state machine is adjusted to be directly proportional to the supply voltage. This allows notes to be played at the desired dynamics even when the supply voltage fluctuates.

22 Claims, 12 Drawing Sheets

| | Total "on" states | |
|---|---|---|
| Hammer Velocity (m/s) | Note 1 (low A) | Note 88 (high C) |
| 0.75 | 432 | 346 |
| 1.00 | 595 | 476 |
| 1.25 | 641 | 513 |
| 1.50 | 735 | 588 |
| 2.00 | 893 | 714 |
| 2.50 | 1351 | 1081 |

150

Fig. 2

SYSTEM AND METHOD FOR DRIVING ACTUATORS IN A REPRODUCING PIANO

BACKGROUND OF THE INVENTION

1. Field of the Invention

The present invention relates to a system and method for controlling mechanically-driven musical instruments, and in particular to a system and method for controlling the drive of solenoid actuators in a mechanically-driven piano or other instrument.

2. Background of the Technology

Beginning with the invention of pneumatically-driven reproducing pianos in the early twentieth century, systems and methods have been developed for recording music played by a human pianist and for reproducing that music on a piano. Many of these systems and methods have attempted to reproduce not only the temporal sequence of notes played by the pianist, but also their dynamics or the sharp contrasts and subtle shadings in loudness that help to make piano performances pleasing. The overall problem of reproducing dynamics can be divided into two distinct parts: recording the dynamics played by a pianist, and recreating these dynamics on a piano.

The problem of recording the dynamics played by a pianist is addressed, for example, in U.S. Pat. No. 4,307,648 to Wayne Stahnke, the entirety of which is incorporated herein by reference. However, there is an unmet need in the art for improved systems and methods for recreating the recorded dynamics.

In an application such as a mechanically-driven piano, recorded music is recreated, for example, using solenoids or other actuators. One solenoid or other actuator is provided for each key of the piano. Each solenoid or other actuator controls the movement of one piano key to recreate recorded music. The solenoids or other actuators may be operated at various speeds to recreate the dynamics of the recorded music.

The solenoids or other actuators are driven, for example, using switching-mode drivers. One switching-mode driver is provided for each solenoid or other actuator, and thus, each switching-mode driver controls one key of the piano. The switching-mode drivers are either fully "on" or fully "off." When a particular note is not to be played, the switching-mode driver for that note is off.

When a particular note is to be played, the switching-mode driver for that note alternates between the on and off states at a high rate, such as, for example, a rate above the limit of audibility. By controlling the proportion of time the switching-mode driver is turned on, the loudness of the note can be controlled. For example, if a loud note is desired, the switching-mode driver is turned on for a large proportion of the time. The solenoid or other actuator is operated at a relatively fast speed, and a relatively loud note is played. In contrast, if a soft note is desired, the switching-mode driver is turned off for a large proportion of the time. The solenoid or other actuator is operated at a relatively slow speed, and a relatively soft note is played.

In some systems, each switching-mode driver is controlled independently. However, other implementations control two or more switching-mode drivers in synchronism, which reduces the cost. Such a system is described, for example, in U.S. Pat. No. 5,022,301 to Wayne Stahnke, which is incorporated herein by reference in its entirety.

Historically, analog circuitry has been used to generate the control signals for the switching-mode driver. However, the advent of high-speed digital circuitry makes it feasible to control the switching-mode drivers using purely digital circuitry. In one such digital system, a plurality of digital counters is used to control the switching-mode drivers. One digital counter is used to control each key.

However, this system suffers from several shortcomings. First, because one counter is used for each key, the system is complex and costly. Second, counters exhibit limited speed due to the fact that carry signals must be propagated from stage to stage. The limited operating speed of the counters limits the resolution of the switching-mode drivers. This results in a relatively limited number of distinct dynamic levels, thereby limiting the accuracy of the reproduction.

The solenoids or other actuators are driven from a supply voltage that is derived from local power mains. The voltage of the power mains, nominally 117 Volts Alternating Current at 60 Hertz in the United States, actually varies during the course of the day due to varying power demands on the local power distribution system. Local changes in load, such as a change caused by starting household appliances or playing many loud notes at once, can also affect the voltage of the power mains.

In order to obtain a fine musical result, the effect of fluctuations in supply voltage should be reduced or eliminated. Many prior art systems contain a power supply that regulates the supply voltage provided to the solenoids or other actuators. Regulating the supply voltage ensures that a constant voltage is provided to the solenoids or other actuators, and the effect of fluctuations is thereby reduced or eliminated. The power supply used in the prior art systems contains a regulator circuit that is capable of controlling the large currents that appear when many notes are played at once. However, the regulator circuit adds to the complexity and cost of the system.

There is an unmet need in the art for an improved system and method for controlling solenoids or other actuators while reducing complexity and cost. There is a further need to provide a system and method with increased resolution of the switching-mode drivers. There is an unmet need in the art to provide a system that compensates for fluctuations in the supply voltage while reducing complexity and cost. Other problems in music reproduction technology exist.

SUMMARY OF THE INVENTION

In light of the shortcomings of the above-mentioned systems, it is an object of the invention to reduce the cost and complexity of the system. It is a further object of the invention to increase the resolution of the switching-mode drivers. It is yet another object of the present invention to reduce the effect of fluctuations in the supply voltage.

In one embodiment of the present invention, a single finite state machine is provided to control all the switching-mode drivers. Thus, the counters of the prior art systems may be eliminated, reducing complexity and cost.

In embodiments of the present invention, the finite state machine used to control the switching-mode drivers is, for example, a shift register or a toggle register. Thus, the finite state machine does not propagate a carry from stage to stage, and the operating speed is increased.

In embodiments of the present invention, the period of the finite state machine is adjusted to be directly proportional to the supply voltage. This allows notes to be played at the desired dynamics even when the supply voltage fluctuates. Therefore, the voltage regulators of the prior art systems may be eliminated, reducing complexity and cost.

When a note is to be played, the desired dynamic may be mapped into a start vector and a stop vector. When the state of the finite state machine is equal to the start vector, the switching-mode driver is turned on. When the state of the finite state machine is equal to the stop vector, the switching-mode driver for that note is turned off.

BRIEF DESCRIPTION OF THE FIGURES

In the drawings:

FIG. 2 illustrates an example lookup table, in accordance with an embodiment of the present invention;

DETAILED DESCRIPTION

The present invention provides a method and system for driving a plurality of solenoids or other actuators in a mechanical piano or other instrument. Given a desired dynamic for a note to be played, the drive required to achieve the dynamic is determined, for example, by accessing a lookup table or by calculating the drive according to a known equation. The drive is then mapped into a start vector and a stop vector, which correspond to a first state and a second state of a finite state machine. The finite state machine is, for example, a free-running state machine such as a shift register. The solenoid drive is turned on when the state of the finite state machine becomes identical to the start vector, and the solenoid drive is subsequently turned off when the state of the finite state machine becomes identical to the stop vector.

If the repetition rate of the state machine period is fixed, the mean drive will be proportional to the supply voltage, and the actual dynamic will therefore depend on the supply voltage. Because the supply voltage can fluctuate, this results in uneven and fluctuating dynamics, which can be displeasing to the ear.

This problem can be overcome, however, by making the period of the finite state machine proportional to the supply voltage. To achieve this, a signal proportional to the supply voltage is mapped to a restart vector. The finite state machine is restarted when its state becomes identical to the restart vector. This makes the repetition rate of the finite state machine inversely proportional to the supply voltage.

In one embodiment of the present invention, a single finite state machine governs the drive of all the notes. In one implementation, the start vector is independent of the drive, and is identical for all the notes. The circuitry required for each note consists, for example, of storage for the stop vector and a comparator to signal when the stop vector matches the state of the finite state machine.

Example embodiments will now be described in conjunction with the following figures.

Figure 1:
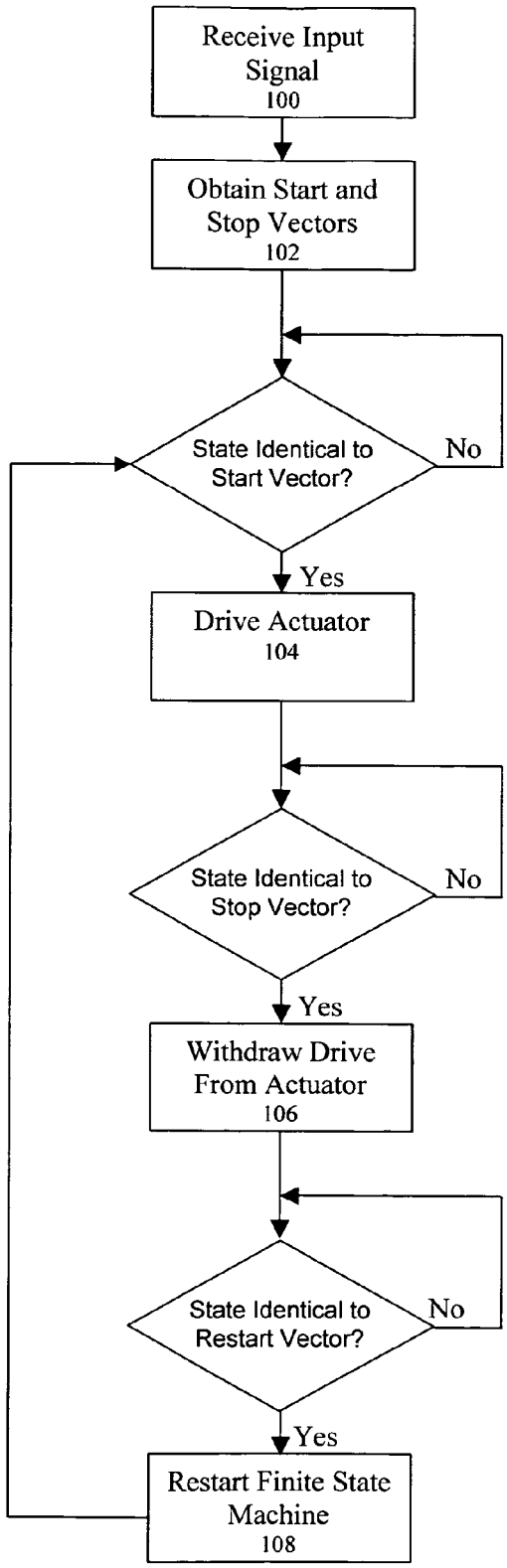
FIG. 1 is a flow chart depicting a method for reproducing a note in accordance with an embodiment of the present invention.

FIG. 1 is a flow chart depicting a method for reproducing a note, in accordance with an embodiment of the present invention. The method may begin in step 100, wherein an input signal is received. The input signal specifies the music to be played on a piano, including the temporal sequence of notes and the dynamics. In embodiments, other reproducing instruments, such as a harpsichord, or other instruments or devices may be controlled. The input signal may be received, for example, from a floppy disk, compact disc, computer memory, or other appropriate medium. In one embodiment, the input signal is the signal described in U.S. Pat. No. 4,307,648.

The method continues in step 102, wherein start and stop vectors are obtained. The start and stop vectors are obtained for each note to be played, and depend on the dynamic of the note to be played. In one embodiment, the start and stop vectors for the entire input signal are calculated before playing begins. In another embodiment, the start and stop vectors for each note are calculated as needed.

In one embodiment, the start and stop vectors are obtained by consulting a lookup table. In another embodiment, start and stop vectors are calculated by evaluating an equation. Techniques used to obtain start and stop vectors will be described in further detail below with reference to FIG. 2.

During the playing of music on a piano or other instrument, a finite state machine is in continuous operation. The finite state machine controls the drive to the actuators operating the keys of the piano. The operation of the finite state machine is discussed further below with reference to FIG. 5.

During the playing of music on a piano, notes are played in the temporal sequence described by the input signal. When the input signal specifies that a note is not to be played, no drive is provided to the actuator for that note. When the input signal specifies that a note is to be played, it is determined whether the state of the finite state machine is identical to the start vector. If the state of the finite state machine is identical to start vector, drive is provided to the actuator 104. When it is determined that the state of the finite state machine is identical to the stop vector, the drive to the actuator is withdrawn 106.

In the case where the note is not to be played, the start vector and the stop vector may be set to be identical. In this case, the signal used to withdraw the drive from the actuator may be set to override the signal used to apply drive to the actuator. Thus, if it is determined that the state of the finite state machine is identical both to the start vector and to the stop vector simultaneously, no drive is applied to the actuator, and the note is not sounded.

In the time that the actuator moves the hammer toward the string, the finite state machine will typically complete many cycles. Thus, in the time the hammer is being moved toward the string, the actuator will repeat through many on-off cycles. The greater the proportion of time the actuator is on, the greater the speed of the hammer, and the louder the resulting note.

In one embodiment of the invention, the period of the finite state machine is controlled to be proportional to the supply voltage. The control of the period of the finite state machine will be described further below in reference to FIGS. 8-9. In this embodiment, it is determined whether the state of the finite state machine is identical to a restart vector. If the state of the finite state machine is identical to the restart vector, the finite state machine is restarted 108.

Figure 3:
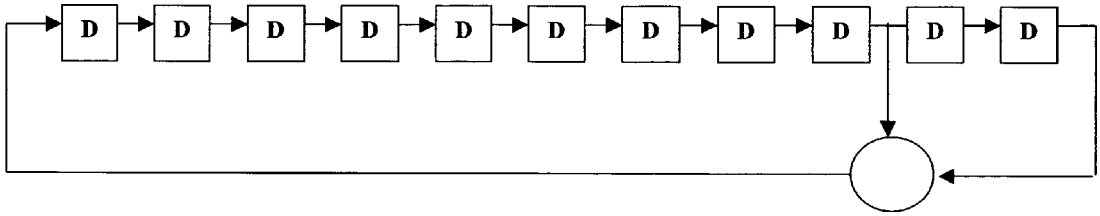
FIG. 3 illustrates an exemplary finite state machine, in accordance with an embodiment of the present invention.

FIG. 2 illustrates an example lookup table 150, in accordance with an embodiment of the present invention. The lookup table 150 is a lookup table that is used, for example, with a finite state machine 300 as shown in FIG. 3. In accordance with embodiments of the present invention, a lookup table contains start and stop vectors for various dynamics, or contains information that is used to generate start and stop vectors for various dynamics. Given a particular dynamic, the start and stop vectors for that dynamic may be obtained from a lookup table by directly obtaining the vectors from the lookup table, or by performing a calculation using information contained in the lookup table. Controlling the actuator for a particular note in accordance with the obtained start and stop vectors will result in the desired dynamic.

The dynamic for a particular note is determined by the fraction of time the actuator for that note is on. Consequently, the start vectors for all notes at all times may be identical. The stop vector for a particular note for a particular dynamic may then be set a predetermined number of states behind the start vector. For example, a note to be played loudly may have a stop vector many states behind the start vector, resulting in an actuator that is on for a relatively large proportion of the time. Conversely, a note to be played softly may have a stop vector only a few states behind the start vector, resulting in an actuator that is on for a relatively small proportion of the time.

In one implementation of a lookup table, the start vectors for all notes are the same. For example, the start vector for all notes is set to be 10000000000, or any other vector for the finite state machine being used. In this case, only the stop vectors may be stored in the lookup table.

In an alternate embodiment, the stop vector is the same for all notes at all times, and the start vector varies with the desired dynamic. In yet another embodiment, both the start vector and the stop vector are determined based on the desired dynamic.

In one embodiment, a lookup table is not used to determine the start and stop vectors. The start and stop vectors are calculated according to a known equation. In yet another embodiment, the lookup table specifies the proportion of time an actuator is to be on given a desired dynamic. The start and stop vectors are then calculated from the information obtained from the lookup table.

In the particular implementation shown in FIG. 2, for a given dynamic, the lookup table 150 specifies the number of states for which the actuator is to be turned on. The start and stop vectors are calculated based on the number of states specified in the lookup table 150.

Because the performance of the solenoids or other actuators may vary significantly, the type of solenoids or other actuators used impacts the loudness of the notes. In order to achieve consistent dynamics, the performance of the solenoids or other actuators is measured and used to create the lookup table 150 or the equation used to calculate the start and stop vectors. The lookup table 150 or the equation is therefore determined experimentally by providing various start and stop vectors to the solenoid or other actuator and measuring the resulting dynamics.

Furthermore, heavier hammers are used to strike lower notes on the piano. Thus, in order to obtain the same dynamic, the actuator for a lower note should be provided with greater drive than the actuator for a higher note. In one implementation of the present invention, the lookup table 150 is therefore a two-dimensional table, and the drive start and stop vectors depend not only on the dynamic to be played, but also on the note to be played. If a known equation is used to determine the start and stop vector, the known equation may calculate the start and stop vector based on, for example, the desired dynamic and the mass of the hammer. Alternatively, a separate known equation may be provided for each note on the piano or other instrument.

The lookup table 150 or known equation(s) may be determined experimentally by providing various start and stop vectors to the actuator for each note on the piano or other instrument and measuring the resulting dynamics.

The lookup table 150 represents dynamics in terms of hammer velocity, expressed in meters per second (m/s). However, dynamics may be represented in other ways. In the particular implementation shown in FIG. 2, to achieve a dynamic of 0.75 m/s, for a low A, the stop vector is set to be 432 states behind the start vector. To achieve the same dynamic for a high C, the stop vector is set to be 346 states behind the start vector. To achieve the same dynamic for any other note, interpolation may be performed. In this particular example, the interpolation is, for example, linear interpolation. In other implementations, the lookup table may store stop vectors for other notes as well, and higher-order interpolation may be performed. In various implementations, notes instead of or in addition to low A and high C may be used, and extrapolation may be used instead of or in addition to interpolation. In other implementations, values are given for all notes at all desired dynamic levels, and no interpolation or extrapolation is necessary.

As further shown in the lookup table 150 of FIG. 2, for this particular implementation, for a low A, to achieve a dynamic of 0.75 m/s, the stop vector is set to be 432 states behind the start vector. To achieve a dynamic of 1.00 m/s for the same note, the stop vector is set to be 595 states behind the start vector. To obtain other dynamics for this note, interpolation or extrapolation may be performed. In the case where a note not listed in the lookup table 150 is to be played at a dynamic not listed in the lookup table 150, interpolation and/or extrapolation may also be performed based on the values listed in the lookup table 150.

FIG. 3 illustrates an exemplary finite state machine 300, in accordance with an embodiment of the present invention. The finite state machine 300 is one example of a finite state machine used to control the actuators, according to the present invention.

The finite state machine used to control the actuators can be designed in several ways. In one embodiment, it is a linear finite state machine, the construction of which follows from the existence of certain primitive binary polynomials. These primitive binary polynomials are described, for example, in the paper "Primitive Binary Polynomials," Mathematics of Computation, Vol. 27, No. 127, pp. 977-980 (October 1973), by Wayne Stahnke, which is incorporated herein by reference in its entirety. "Primitive Binary Polynomials" describes polynomials of degree $n \leqq 168$ that yield linear feedback shift registers of minimal complexity. Finite state machines that are constructed, for example, according to the polynomials described in "Primitive Binary Polynomials" may be used in the present invention. In alternate implementations, other types of finite state machines may be used.

The finite state machine 300 may be a linear finite state machine that is constructed according to the polynomial $x^{11}+x^2+1$, as described in "Primitive Binary Polynomials."

Figure 4:
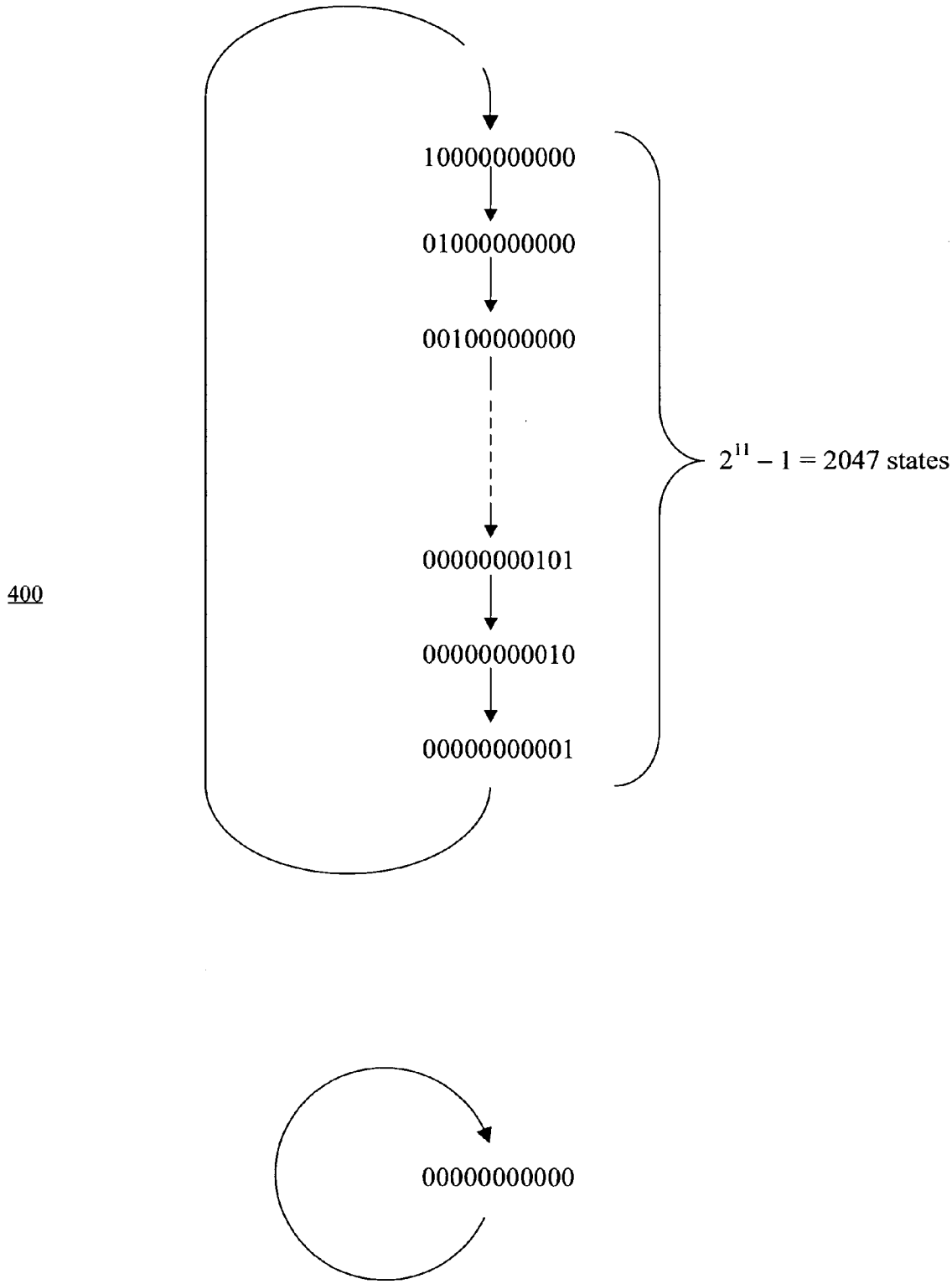
FIG. 4 presents a state diagram illustrating the states of the finite state machine of FIG. 3.

FIG. 4 presents a state diagram 400 illustrating the states of the finite state machine of FIG. 3. As shown in FIG. 4, the state diagram 400 includes 2047 states plus the all-zero trivial state. If the finite state machine 300 of FIG. 3 is used, the softest dynamic may be mapped, for example, into a start vector of 10000000000 and a stop vector of 00110010100, and the loudest dynamic may be mapped, for example, into a start vector of 10000000000 and a stop vector of 10100101010. The restart vector for the finite state machine is expected to vary, for example, between 01010010101 and 00000000001 during normal operation. The stop vector of the loudest dynamic is chosen, for example, such that it is not in the range of expected restart vectors. Other mappings for the finite state machine 300 are possible.

Figure 5:
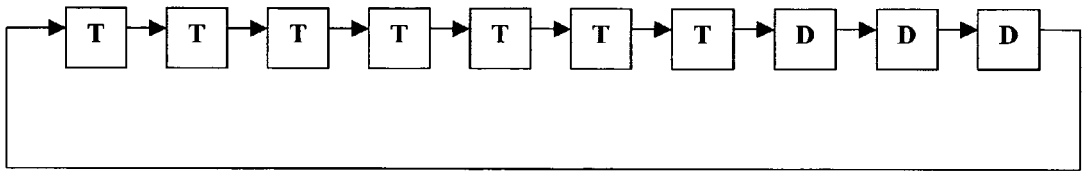
FIG. 5 illustrates an exemplary finite state machine, in accordance with an embodiment of the present invention.

FIG. 5 illustrates an exemplary finite state machine 500, in accordance with an embodiment of the present invention. The finite state machine 500 is one example of a finite state machine used to control the actuators, according to the present invention.

The finite state machine used to control the actuators can be designed in several ways. In one embodiment, it is a linear finite state machine, the construction of which follows from the existence of certain toggle register polynomials. These toggle register polynomials are described, for example, in the paper "On the Toggle Register Polynomial," Information and Control, Vol. 39, No. 2, pp. 149-157 (November 1978), by Wayne Stahnke, which is incorporated herein by reference in its entirety. "On the Toggle Register Polynomial" describes polynomials of degree $n \leqq 137$ that yield linear feedback toggle registers of minimal complexity. Finite state machines that are constructed, for example, according to the polynomials described in "On the Toggle Register Polynomial" may be used in the present invention. In alternate implementations, other types of finite state machines may be used.

The finite state machine 500 may be a linear finite state machine that is constructed according to the polynomial $x^{10}+(x+1)^7$, as described in "On the Toggle Register Polynomial."

Figure 6:
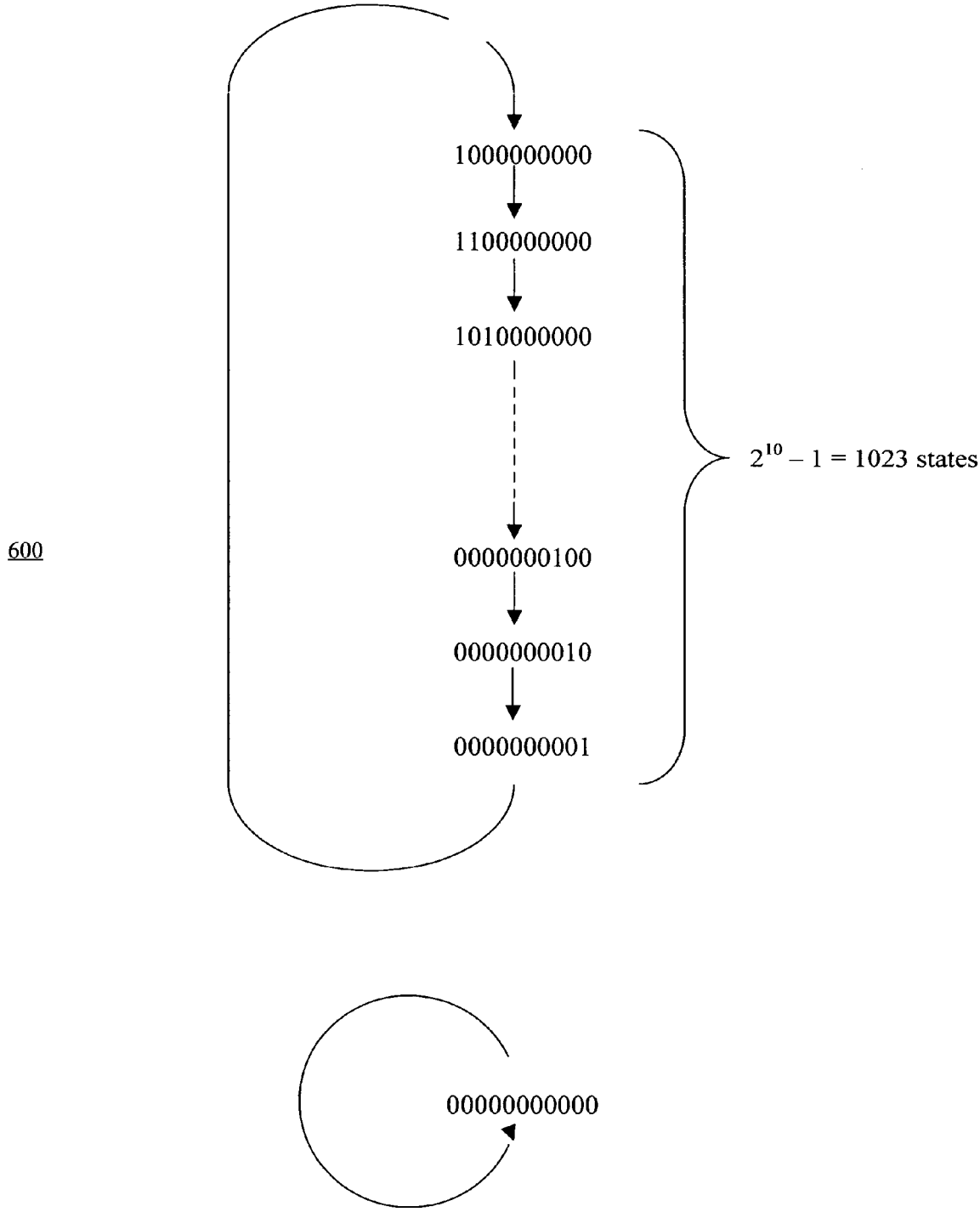
FIG. 6 presents a state diagram illustrating the states of the finite state machine of FIG. 5.

FIG. 6 presents a state diagram illustrating the states of the finite state machine of FIG. 5. As shown in FIG. 6, the state diagram 600 includes 1023 states plus the trivial all-zero state. The process of mapping dynamics to start and stop vectors is similar to that described above with reference to FIGS. 3-4.

Figure 7:
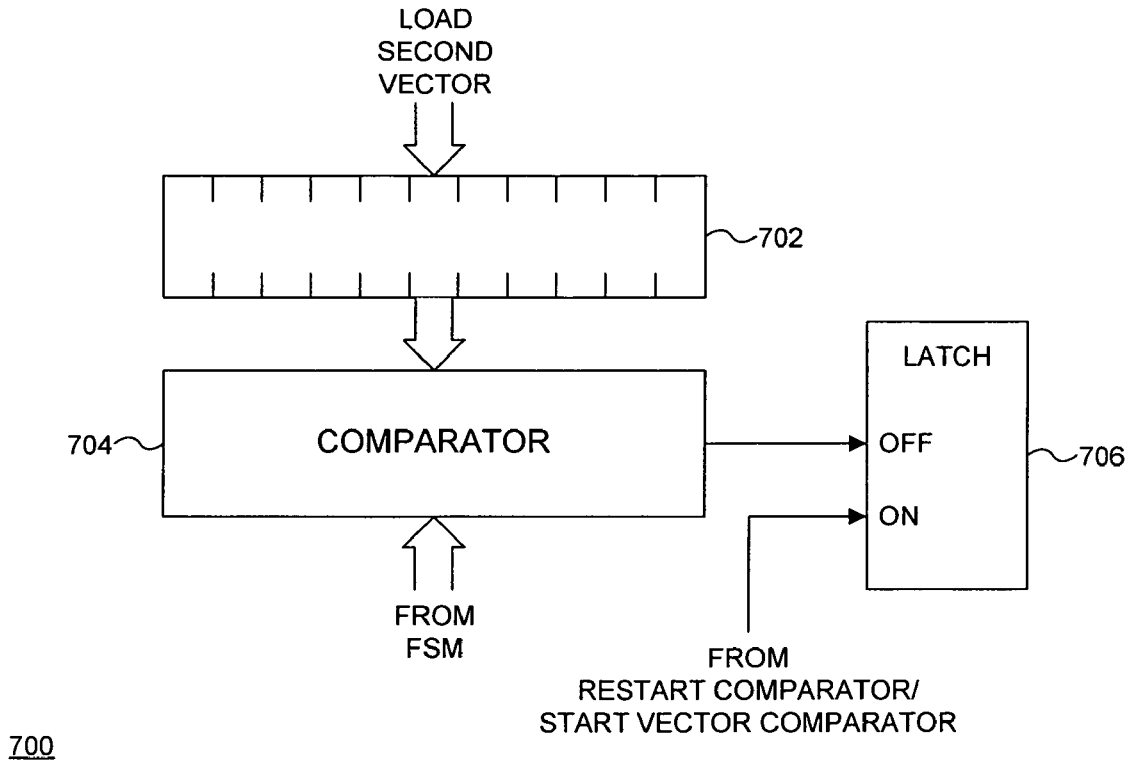
FIG. 7 illustrates circuitry for a single note of a reproducing piano, in accordance with an embodiment of the present invention.

FIG. 7 illustrates circuitry 700 for a single note of a reproducing piano or other instrument, in accordance with an embodiment of the present invention. The circuitry 700 includes a holding register 702, which is used, for example, to store the stop vector for the associated note. The stop vector is received, for example, from the lookup table (not shown in FIG. 7). In an alternate implementation, the holding register 702 is used, for example, to store the start vector. In yet another implementation, two holding registers are provided to store both the start and stop vectors.

The circuitry 700 also includes a comparator 704. The comparator 704 receives the current state from the finite state machine (not shown in FIG. 7) and receives the stop vector or other stored vector from the holding register 702. When the comparator 704 determines that the current state is identical to the stop vector or other stored vector, the comparator 704 outputs a signal to a latch 706.

If the holding register 702 is used to store the stop vector, the signal output from the comparator 704 is, for example, an indication that the drive to the solenoid or other actuator should be withdrawn. However, other implementations are possible.

The latch 706 also receives another signal, for example, from a restart comparator (not shown) or from a start vector comparator (not shown). The signal received from the restart comparator or from the start vector comparator is, for example, an indication that drive should be applied to the actuator.

In one implementation, the latch 706 receives input from a start vector comparator. One start vector comparator may be provided for all the notes. In this case, the start vector may be fixed, and the stop vector dictates the dynamic of the note to be played. When the start vector comparator determines that the current state of the finite state machine is identical to the start vector, the start vector comparator outputs a signal to all of the latches 706 (one latch 706 for each key of the piano or other instrument). The signal is, for example, an indication that drive should be applied to the actuator.

In some implementations of the present invention, the period of the finite state machine is adjusted according to fluctuations in the power supply. In this case, the present invention may include a restart comparator. When the restart comparator determines that the state of the finite state machine is identical to the restart vector, the restart comparator outputs a signal that restarts the finite state machine.

In the case where a restart comparator is used, the start comparator may be eliminated. In this case, the start vector may correspond to, for example, any non-zero state of the finite state machine. In this case, the start vector is fixed, and the stop vector dictates the dynamic of the note to be played. When the restart comparator determines that the finite state machine is to be restarted, it provides a restart signal, and one clock cycle later, the finite state machine is restarted in the first state. Because the start vector is fixed to be identical to the first state, the output of the restart comparator may be delayed by one clock cycle, and then provided to all the latches 706 (one latch for each key of the piano). The signal is, for example, an indication that drive should be applied to the actuator.

In some implementations, both a restart comparator and a start comparator may be provided.

The latch 706 may be designed such that the signal from the comparator 704 overrides the signal from the restart comparator or the start vector comparator. In the case where a note is not to be played, the stop vector for the note is set, for example, to be identical to the start vector. In this case, both the comparator 704 and the restart comparator or start vector comparator provide their respective signals. If the latch 706 is designed such that the signal from the comparator 704 overrides the signal from the restart comparator or the start vector comparator, no drive will be applied to the actuator, and the note will not be played.

Figure 8A:
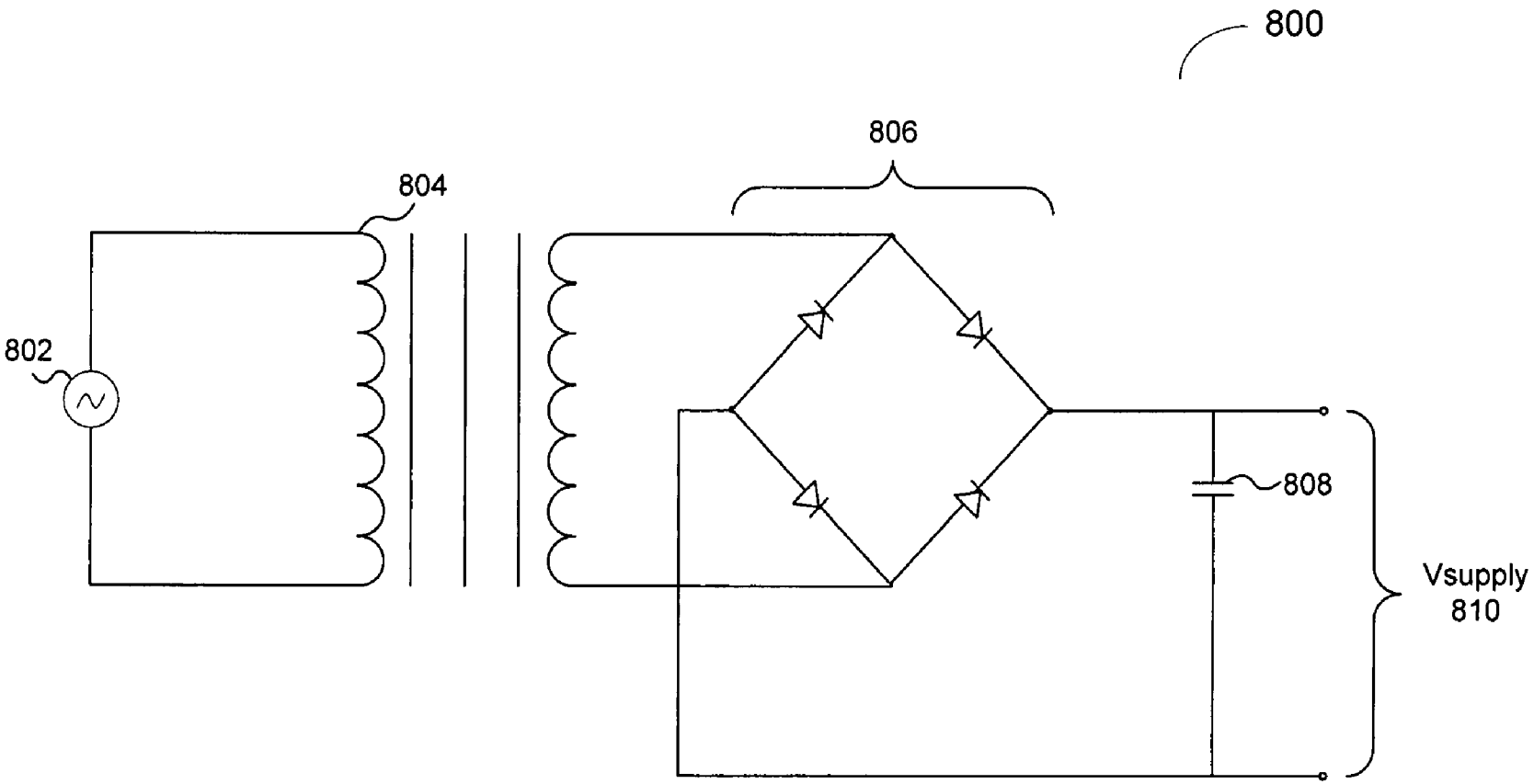
FIG. 8A-B illustrate exemplary power supplies, in accordance with an embodiment of the present invention.

FIG. 8A illustrates an exemplary power supply 800, in accordance with an embodiment of the present invention. As shown in FIG. 8, the power supply 800 includes an input 802, which may be adapted, for example, to receive alternating current, such as U.S. standard 117 Volts Alternating Current at 60 Hz or other power inputs. The power supply 800 further includes a power transformer 804, a diode bridge 806, and a smoothing capacitor 808. The power supply is configured to output a supply voltage at an output 810.

Figure 8B:
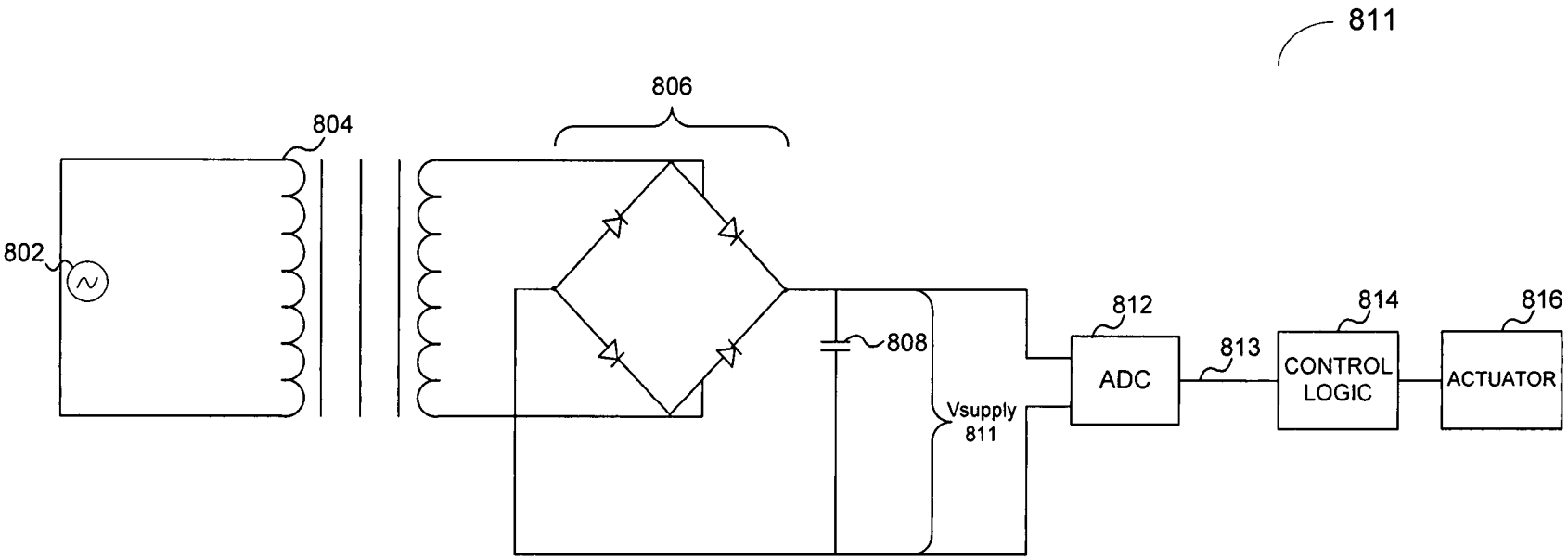

FIG. 8B illustrates an exemplary power supply 811, in accordance with an embodiment of the present invention. The power supply 811 is generally similar to the power supply 800 of FIG. 8A. In embodiments as illustrated, the power supply 811 may be connected to a supply voltage measuring device 812, such as an analog to digital converter (ADC), to measure the supply voltage at the output 810. The power supply measuring device outputs a supply voltage measurement 813, which may be or include, for example, a digital measurement or quantity. The supply voltage measurement 813 is input into control logic 814, which may include, for example, a finite state machine. The supply voltage measurement 813 may be used by control logic 814, for example, to control the period or other characteristics of a periodic signal output by the control logic 814 to compensate for fluctuations in the supply voltage received or produced by power supply 800. The periodic signal output by control logic 814 may drive an actuator 816 for reproduction purposes.

Figure 9A:
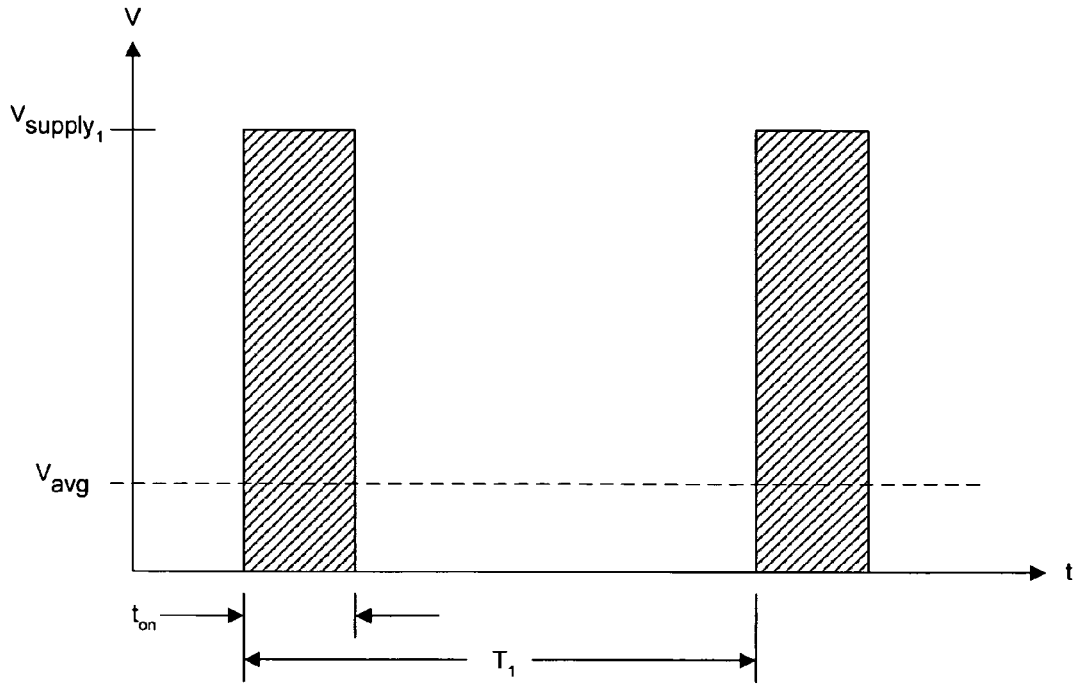
FIGS. 9A-B illustrate exemplary wave forms, in accordance with an embodiment of the present invention.
Figure 9B:
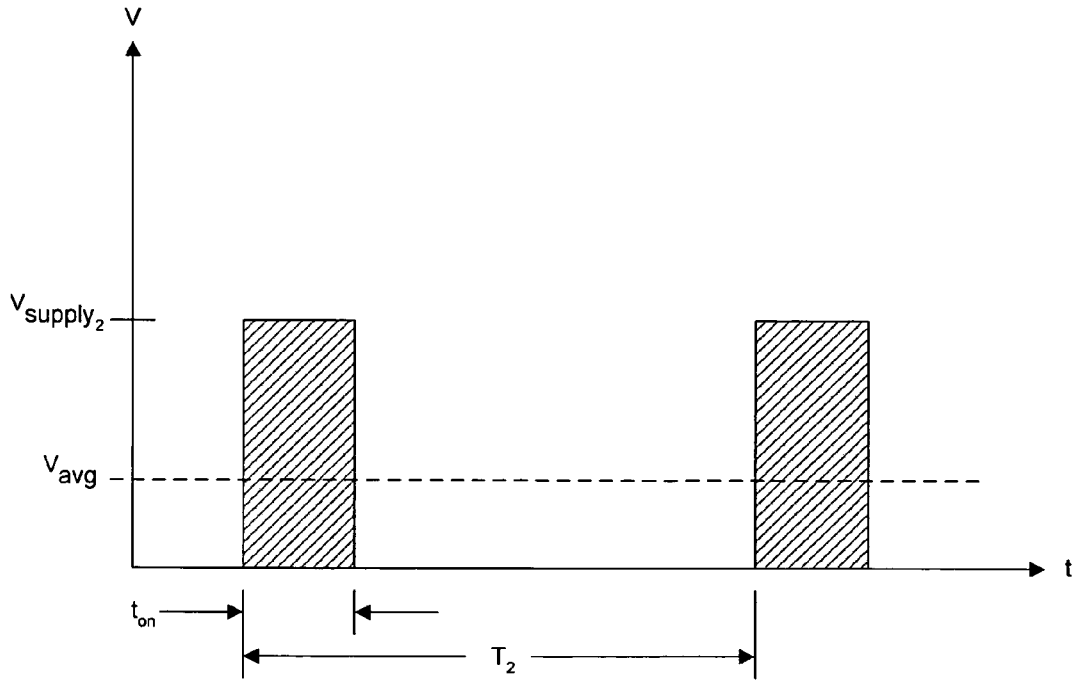

FIGS. 9A-B illustrate exemplary waveforms, in accordance with an embodiment of the present invention. As shown in FIGS. 9A-9B, the average voltage $V_{avg}$ applied to an actuator varies with the desired dynamic and with the supply voltage.

As shown in FIG. 9A, in accordance with an embodiment of the present invention, a periodic signal is applied to an actuator. The periodic signal is, for example, a square wave, which includes an applied voltage time $t_{on}$ during which a voltage is applied to an actuator, and a zero-voltage time, during which no voltage is applied to the actuator. The time $t_{on}$ varies, for example, with the desired dynamic. In one implementation, the time $t_{on}$ also varies based on the note to be played. The time $t_{on}$ begins, for example, when a finite state machine has a state identical to a start state, and ends, for example, when the finite state machine has a state identical to a stop state.

During the applied voltage time $t_{on}$, the voltage applied to the actuator is proportional to the supply voltage $V_{supply1}$. In one implementation, the voltage applied to the actuator is substantially equal to the supply voltage $V_{supply1}$. This allows for simplicity in the design of the power supply.

The period $T_1$ of the waveform also varies directly with the supply voltage $V_{supply1}$. Thus, the average voltage $V_{avg}$ supplied to the actuator may be independent of the supply voltage $V_{supply1}$. The average voltage $V_{avg}$ therefore depends, for example, only on the applied voltage time $t_{on}$.

FIG. 9B shows a waveform applied to an actuator in accordance with an embodiment of the present invention. The waveform shown in FIG. 9B is the waveform applied to the same note, and for the same dynamic, as the waveform shown in FIG. 9A. Thus, the waveform shown in FIG. 9B has an applied voltage time $t_{on}$ that is the same as the applied voltage time $t_{on}$ of FIG. 9A.

However, the waveform shown in FIG. 9B has a supply voltage $V_{supply2}$ that is lower than the supply voltage $V_{supply1}$ of FIG. 9A. As shown in FIG. 9B, the present invention compensates for the change in supply voltage by varying the period such that the average voltage $V_{avg}$ applied to the actuator does not change. As shown in FIG. 9B, when the supply voltage decreases from $V_{supply1}$ to $V_{supply2}$, the period of the applied waveform decreases proportionally, from $T_1$ to $T_2$. Thus, the average voltage $V_{avg}$ applied to the actuator is unchanged. Thus, for the same value of the applied voltage time $t_{on}$, the same dynamic is obtained regardless of changes in the supply voltage.

In one implementation of the present invention, a restart vector is used to alter the period $T_1$, $T_2$ of the applied waveform. In accordance with this implementation, a new period $T_1$, $T_2$ begins when a finite state machine has a state equivalent to the restart vector. The restart vector may be equivalent to the start vector used to signal the beginning of the applied voltage period $t_{on}$, or may be determined based on the start vector. Alternately, the restart vector may be equivalent to the stop vector used to signal the end of the applied voltage period $t_{on}$, or may be determined based on the stop vector.

Figure 10:
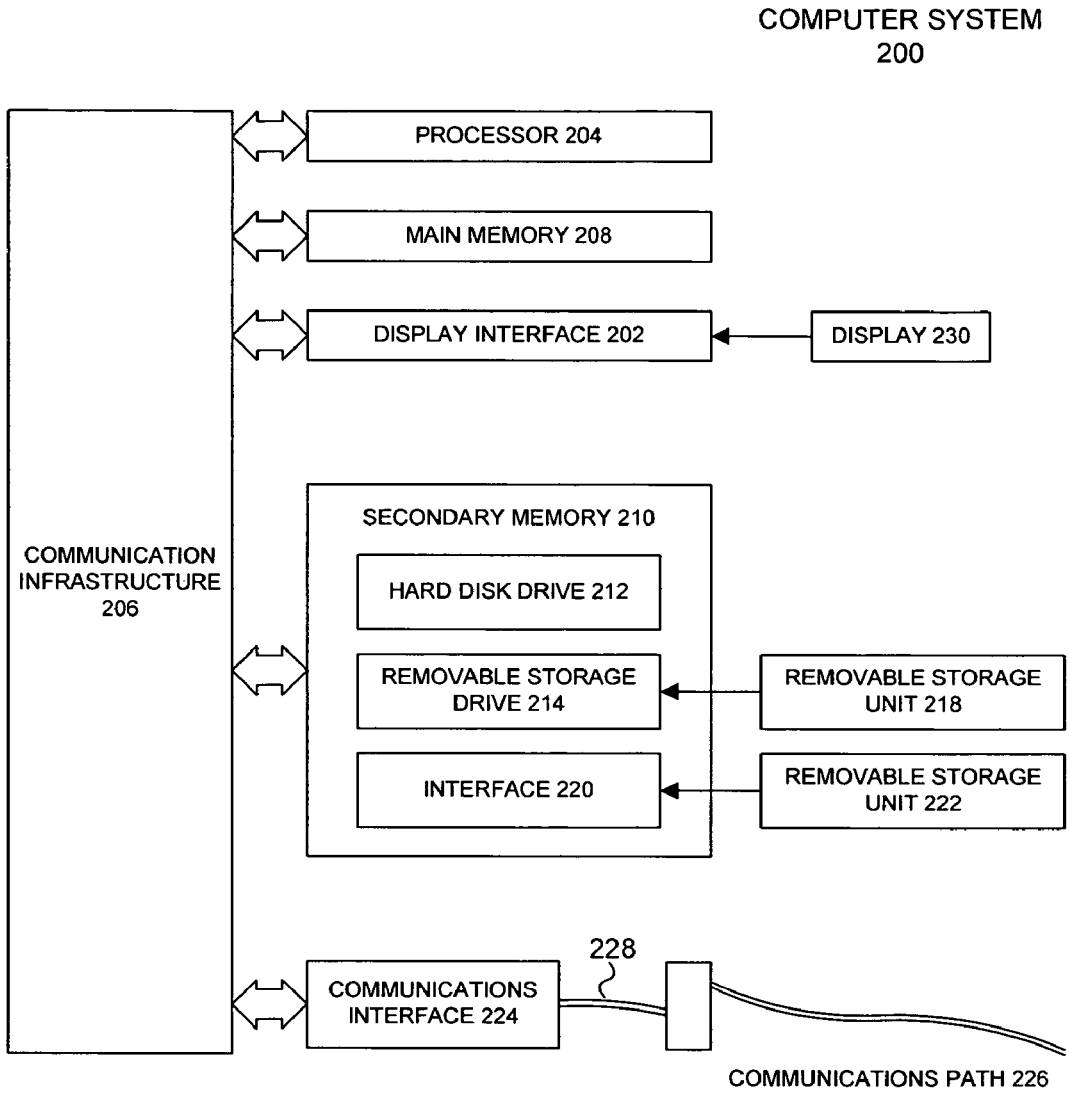
FIG. 10 illustrates an exemplary computer system, in accordance with an embodiment of the present invention.

The present invention may be implemented using hardware, software or a combination thereof and may be implemented in one or more computer systems or other processing systems. In one embodiment, the invention is directed toward one or more computer systems capable of carrying out the functionality described herein. An example of such a computer system 200 is shown in FIG. 10.

Computer system 200 includes one or more processors, such as processor 204. The processor 204 is connected to a communication infrastructure 206 (e.g., a communications bus, cross-over bar, or network). Various software embodiments are described in terms of this exemplary computer system. After reading this description, it will become apparent to a person skilled in the relevant art(s) how to implement the invention using other computer systems and/or architectures.

Computer system 200 can include a display interface 202 that forwards graphics, text, and other data from the communication infrastructure 206 (or from a frame buffer not shown) for display on the display unit 230. Computer system 200 also includes a main memory 208, preferably random access memory (RAM), and may also include a secondary memory 210. The secondary memory 210 may include, for example, a hard disk drive 212 and/or a removable storage drive 214, representing a floppy disk drive, a magnetic tape drive, an optical disk drive, etc. The removable storage drive 214 reads from and/or writes to a removable storage unit 218 in a known manner. Removable storage unit 218, represents a floppy disk, magnetic tape, optical disk, etc., which is read by and written to removable storage drive 214. As will be appreciated, the removable storage unit 218 includes a computer usable storage medium having stored therein computer software and/or data.

In alternative embodiments, secondary memory 210 may include other similar devices for allowing computer programs or other instructions to be loaded into computer system 200. Such devices may include, for example, a removable storage unit 222 and an interface 220. Examples of such may include a program cartridge and cartridge interface (such as that found in video game devices), a removable memory chip (such as an erasable programmable read only memory (EPROM), or programmable read only memory (PROM)) and associated socket, and other removable storage units 222 and interfaces 220, which allow software and data to be transferred from the removable storage unit 222 to computer system 200.

Computer system 200 may also include a communications interface 224. Communications interface 224 allows software and data to be transferred between computer system 200 and external devices. Examples of communications interface 224 may include a modem, a network interface (such as an Ethernet card), a communications port, a Personal Computer Memory Card International Association (PCMCIA) slot and card, etc. Software and data transferred via communications interface 224 are in the form of signals 228, which may be electronic, electromagnetic, optical or other signals capable of being received by communications interface 224. These signals 228 are provided to communications interface 224 via a communications path (e.g., channel) 226. This path 226 carries signals 228 and may be implemented using wire or cable, fiber optics, a telephone line, a cellular link, a radio frequency (RF) link and/or other communications channels. In this document, the terms "computer program medium" and "computer usable medium" are used to refer generally to media such as a removable storage drive 214, a hard disk installed in hard disk drive 212, and signals 228. These computer program products provide software to the computer system 200. The invention is directed to such computer program products.

Computer programs (also referred to as computer control logic) are stored in main memory 208 and/or secondary memory 210. Computer programs may also be received via communications interface 224. Such computer programs, when executed, enable the computer system 200 to perform the features of the present invention, as discussed herein. In particular, the computer programs, when executed, enable the processor 204 to perform the features of the present invention. Accordingly, such computer programs represent controllers of the computer system 200.

In an embodiment where the invention is implemented using software, the software may be stored in a computer program product and loaded into computer system 200 using removable storage drive 214, hard drive 212, or communications interface 224. The control logic (software), when executed by the processor 204, causes the processor 204 to perform the functions of the invention as described herein. In another embodiment, the invention is implemented primarily in hardware using, for example, hardware components, such as application specific integrated circuits (ASICs). Implementation of the hardware state machine so as to perform the functions described herein will be apparent to persons skilled in the relevant art(s).

In yet another embodiment, the invention is implemented using a combination of both hardware and software.

Figure 11:
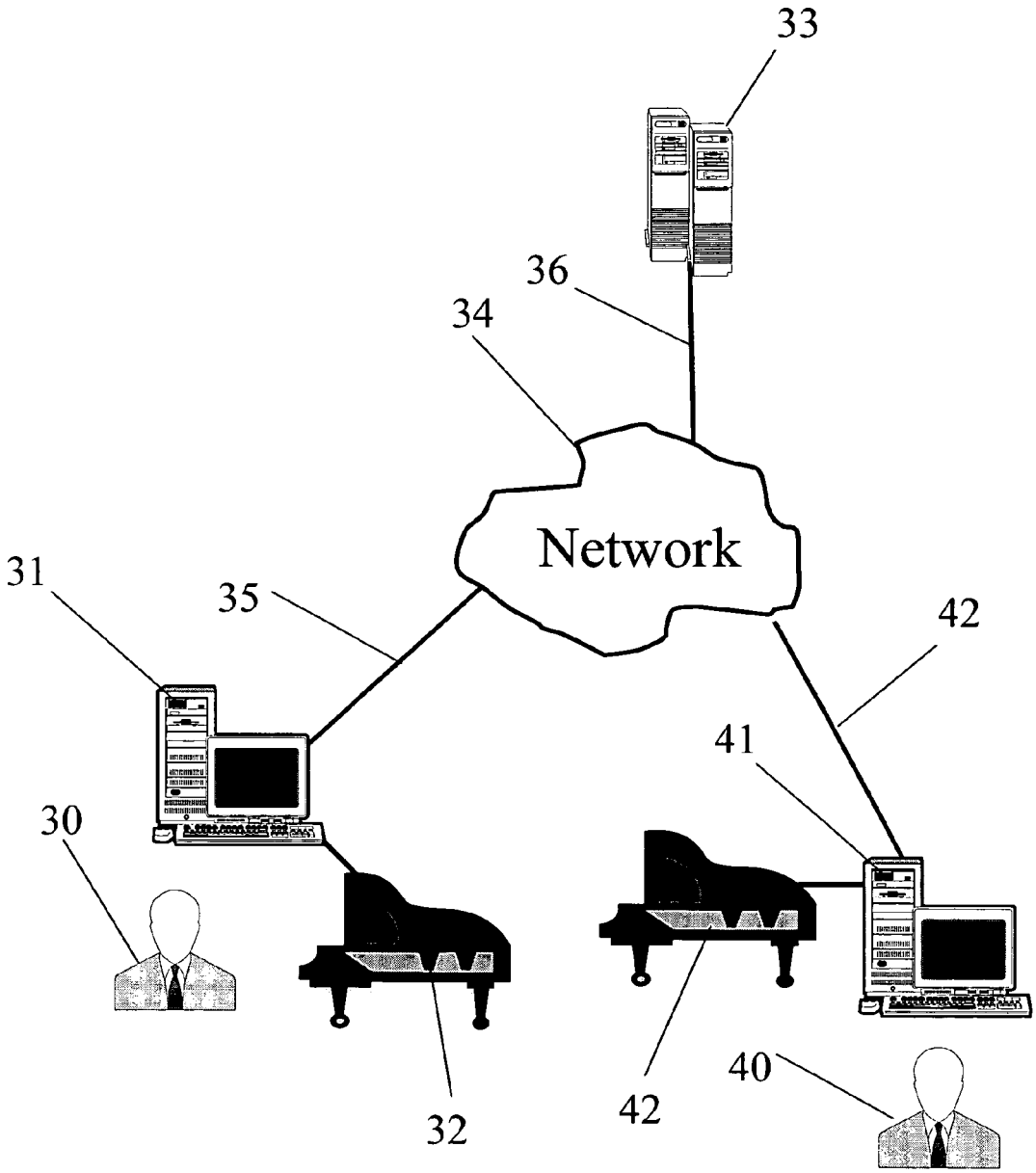
FIG. 11 illustrates an exemplary network diagram, in accordance with an embodiment of the present invention.

FIG. 11 illustrates an exemplary system diagram of various hardware components and other features in accordance with an embodiment of the present invention. As shown in FIG. 11, in an embodiment of the present invention, data and other information and services for use in the system is, for example, input by an end user 30 via a terminal 31. The terminal 31 is incorporated into, or is in communication with, a piano 32 that includes a reproducing system. The terminal 31 is coupled to a server 33 via a network 34, such as the Internet, via couplings 35, 36. In one embodiment, a second user 40 also inputs information/data via a terminal 41 incorporated into or in communication with a piano 42 that includes a reproducing system. In some embodiments, users may input information into terminals not incorporated into and not in communication with pianos.

Each of the terminals 31, 41 is, for example, a personal computer (PC), minicomputer, mainframe computer, microcomputer, telephone device, personal digital assistant (PDA), or other device having a processor and input capability. The terminal 31 is coupled to a server 33, such as a PC, minicomputer, mainframe computer, microcomputer, or other device having a processor and a repository for data or connection to a repository for maintained data.

In operation, in an embodiment of the present invention, the user 30 inputs data, such as data specifying a musical performance, into the terminal 31. The musical performance may be realized on the piano 32 or other instrument. In another embodiment, the terminal 31 receives data, such as data specifying a musical performance, from the terminal 41 via the network 34. The musical performance may be realized on the piano 32 or other instrument. In yet another embodiment, the terminal 31 receives data, such as data specifying a musical performance, from the server 33 via the network 34. The musical performance may be realized on the piano 32 or other instrument.

In embodiments of the present invention, the terminal 41 and the server 33 may be used to store other data used by the terminal 31. For example, the server 33 may be used to store a lookup table or other information used by the terminal 31.

Example embodiments of the present invention have now been described in accordance with the above advantages. It will be appreciated that these examples are merely illustrative of the invention. Variations and modifications will be apparent to those skilled in the art. For example, while the invention has generally been described in terms of a single shift register or a toggle register used to control actuators for a plurality of notes, those skilled in the art will recognize that a single counter can be used to control the plurality of notes. Alternatively, a plurality of shift registers, toggle registers, or other finite state machines can be used to control the plurality of notes. Furthermore, while the invention has been described in terms of a start vector independent of the desired dynamic and a stop vector dependent on the desired dynamic, in other implementations, the stop vector may be independent of the desired dynamic and the start vector may be dependent on the desired dynamic. In another implementation, both the start vector and the stop vector may be dependent on the desired dynamic. In addition, while the invention has been described in terms of a start vector, a stop vector, and a restart vector, the restart vector may be equivalent to either the start vector or the stop vector, or may be derived based on the start vector or the stop vector. In one implementation, one or more delay registers may be inserted between the finite state machine and the comparator, or between the comparator and the actuator, such that a delay is effected before the actuator is turned on or off. In this case, the finite state machine reaching the start vector or the start vector will trigger the actuator to turn on or off, although the finite state machine will have advanced by one or more states by the time the effect is seen in the actuator. Other modifications will be apparent to those skilled in the art.

The invention claimed is:

1. A method for providing a signal to an actuator in an instrument, comprising:

receiving a supply voltage;

controlling the period of a finite state machine such that the period increases in response to an increase in the supply voltage and decreases in response to a decrease in the supply voltage; and applying a periodic signal to the actuator;

wherein the amplitude of the signal increases in response to an increase in the supply voltage and decreases in response to a decrease in the supply voltage; and wherein the period of the signal varies based on the period of the finite state machine.

2. A method according to claim 1, wherein the average voltage supplied to the actuator is independent of the supply voltage.

3. A method according to claim 1, wherein the average voltage supplied to the actuator is proportional to a desired drive of the actuator.

4. A method according to claim 1, wherein the signal comprises an applied voltage time during which voltage is applied to the actuator, and a zero-voltage time during which no voltage is applied to the actuator.

5. A method according to claim 4, wherein the applied voltage time is proportional to a desired drive of the actuator.

6. A method according to claim 1, wherein the amplitude of the signal is substantially equal to the supply voltage.

7. A method according to claim 1, wherein the amplitude of the signal varies proportionally with the supply voltage.

8. A method according to claim 1, wherein the period of the signal varies proportionally with the supply voltage.

9. A system for providing a signal to an actuator in an instrument, comprising:

means for receiving a supply voltage;

means for controlling the period of a finite state machine such that the period increases in response to an increase in the supply voltage and decreases in response to a decrease in the supply voltage; and means for applying a periodic signal to the actuator;

wherein the amplitude of the signal increases in response to an increase in the supply voltage and decreases in response to a decrease in the supply voltage; and wherein the period of the signal is varies based on the period of the finite state machine.

10. A method for providing a signal to an actuator in an instrument, comprising:

receiving a supply voltage;

measuring the supply voltage; and applying a periodic signal to the actuator;

wherein the amplitude of the signal increases in response to an increase in the supply voltage and decreases in response to a decrease in the supply voltage; and wherein the period of the signal increases in response to an increase in the supply voltage measurement and decreases in response to a decrease in the supply voltage measurement.

11. A method according to claim 10, wherein the average voltage supplied to the actuator is independent of the supply voltage.

12. A method according to claim 10, wherein the average voltage supplied to the actuator is proportional to a desired drive of the actuator.

13. A method according to claim 10, wherein the signal comprises an applied voltage time during which voltage is applied to the actuator, and a zero-voltage time during which no voltage is applied to the actuator.

14. A method according to claim 13, wherein the applied voltage time is proportional to a desired drive of the actuator.

15. A method according to claim 10, wherein the amplitude of the signal is substantially equal to the supply voltage.

16. A method according to claim 10, wherein the amplitude of the signal varies proportionally with the supply voltage.

17. A method according to claim 10, wherein the period of the signal varies proportionally with the supply voltage.

18. A method according to claim 10, wherein the supply voltage measurement comprises a digital measurement.

19. A system for providing a signal to an actuator in an instrument, comprising:

means for receiving a supply voltage;

means for measuring the supply voltage; and means for applying a periodic signal to the actuator;

wherein the amplitude of the signal increases in response to an increase in the supply voltage and decreases in response to a decrease in the supply voltage; and wherein the period of the signal increases in response to an increase in the supply voltage measurement and decreases in response to a decrease in the supply voltage measurement.

20. An actuator for driving sound reproduction in an instrument, the actuator being driven according to a method comprising:

receiving a supply voltage;

controlling the period of a finite state machine such that the period increases in response to an increase in the supply voltage and decreases in response to a decrease in the supply voltage; and generating a periodic signal to be applied to the actuator;

wherein the amplitude of the signal increases in response to an increase in the supply voltage and decreases in response to a decrease in the supply voltage; and wherein the period of the signal is varies based on the period of the finite state machine.

21. An actuator for driving sound reproduction in an instrument, the actuator being driven according to a method comprising:

receiving a supply voltage;

measuring the supply voltage; and generating a periodic signal to be applied to the actuator;

wherein the amplitude of the signal increases in response to an increase in the supply voltage and decreases in response to a decrease in the supply voltage; and wherein the period of the signal increases in response to an increase in the supply voltage measurement and decreases in response to a decrease in the supply voltage measurement.

22. An actuator according to claim 21, wherein the supply voltage measurement comprises a digital measurement.

* * * * *